US008499371B1

(12) United States Patent
Becker

(10) Patent No.: US 8,499,371 B1
(45) Date of Patent: Aug. 6, 2013

(54) INFLATABLE TOILET SHELTER

(76) Inventor: Mark A. Becker, Alexandria, MN (US)

( * ) Notice: Subject to any disclaimer, the term of this patent is extended or adjusted under 35 U.S.C. 154(b) by 0 days.

(21) Appl. No.: 13/598,502

(22) Filed: Aug. 29, 2012

(51) Int. Cl.
*A47K 11/04* (2006.01)

(52) U.S. Cl.
USPC ..... 4/476; 4/477; 4/479; 4/483

(58) Field of Classification Search
USPC ..... 4/449, 458, 460, 476, 479, 483, 482, 4/477; 52/2.17
See application file for complete search history.

(56) References Cited

U.S. PATENT DOCUMENTS

| | | | | |
|---|---|---|---|---|
| 268,240 | A | 11/1882 | Jones | |
| 1,033,108 | A | 7/1912 | Lehmann | |
| 1,508,888 | A | 9/1924 | Klatt | |
| 1,538,311 | A | 5/1925 | Anticknap | |
| 1,639,074 | A | 8/1927 | Blackwood | |
| 1,652,581 | A | 12/1927 | Roberts | |
| 1,990,804 | A | 2/1935 | Watson | |
| 2,811,977 | A | 11/1957 | McClish | |
| 3,094,707 | A | 6/1963 | Fleming | |
| 3,243,230 | A | 3/1966 | Otto | |
| 3,284,965 | A | 11/1966 | Michenfelder | |
| 3,629,875 | A | 12/1971 | Dow et al. | |
| 3,986,215 | A | 10/1976 | Amalfitano | |
| 4,785,483 | A | 11/1988 | Wise | |
| 4,883,016 | A | 11/1989 | Larson | |
| 4,909,268 | A | 3/1990 | Maggio | |
| 4,914,768 | A | 4/1990 | Howard | |
| 4,915,120 | A | 4/1990 | Ziolkowski | |
| 4,924,896 | A | 5/1990 | Carter | |
| 4,974,265 | A | 12/1990 | Maggio | |
| 4,979,242 | A | 12/1990 | Maggio | |
| 5,029,348 | A | 7/1991 | Boren | |
| 5,095,556 | A | 3/1992 | Franey | |
| 5,135,281 | A | 8/1992 | Pappalardo | |
| 5,203,363 | A | 4/1993 | Kidwell et al. | |
| 5,379,466 | A | 1/1995 | Davies | |
| 5,416,933 | A | 5/1995 | Bernard | |
| 5,586,344 | A | 12/1996 | Liang | |
| D378,540 | S | 3/1997 | Becker | |
| 5,920,927 | A * | 7/1999 | Thomas | 4/460 |
| 5,937,452 | A | 8/1999 | Brewer | |
| 6,079,058 | A * | 6/2000 | Green | 4/479 |
| 6,378,142 | B1 | 4/2002 | Gray | |
| 2001/0044952 | A1 | 11/2001 | Becker | |
| 2002/0083653 | A1 * | 7/2002 | Hilbert | 52/2.17 |
| 2009/0025302 | A1 | 1/2009 | Wang | |

FOREIGN PATENT DOCUMENTS

| | | |
|---|---|---|
| EP | 0389204 A1 | 9/1990 |
| EP | 0689790 A1 | 1/1996 |
| FR | 1490621 A | 6/1967 |

* cited by examiner

*Primary Examiner* — Tuan N Nguyen
(74) *Attorney, Agent, or Firm* — Albert W. Watkins

(57) ABSTRACT

A portable toilet for marine craft securely located on the deck of a boat and including an inflatable privacy cover. The toilet includes a seat assembly and a box-shaped housing for a portable toilet. The boat seat assembly includes a boat seat, a boat seat back, and a support brace, made up of first and second support members hinged together. The first member connects the boat seat back to the second support member. The inner surface of the second support member defines a seat receiving portion for the boat seat. An inflatable cover is coupled to the boat seat housing and defines a pressurizable interior. A fan forcing air from an exterior of the inflatable toilet shelter to the pressurizable interior operatively inflates the inflatable cover. The inflatable toilet shelter can also have a swivel attached to the bottom for allowing the toilet to be vertically pivoted.

9 Claims, 7 Drawing Sheets

FIG. 5
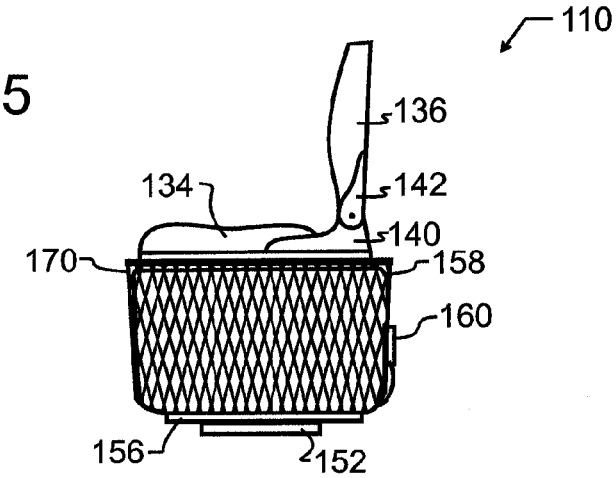
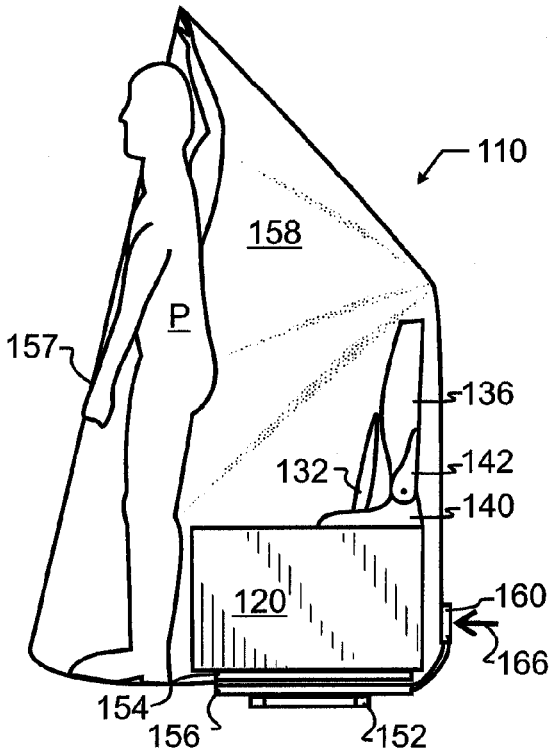
FIG. 6
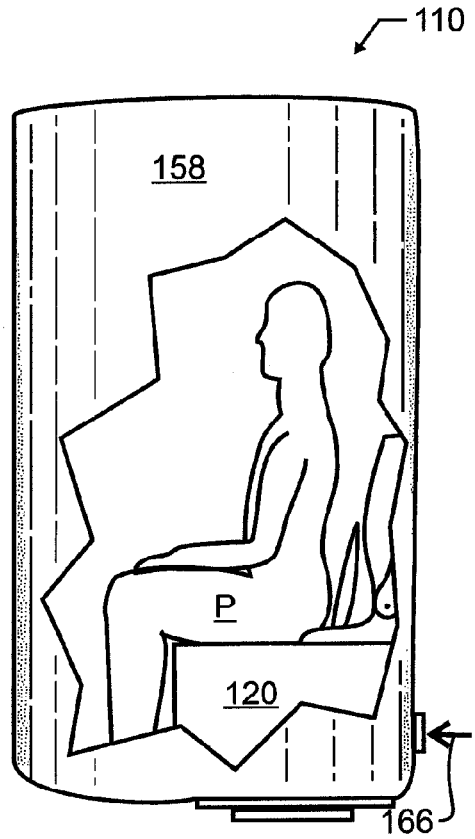
FIG. 7

FIG. 9
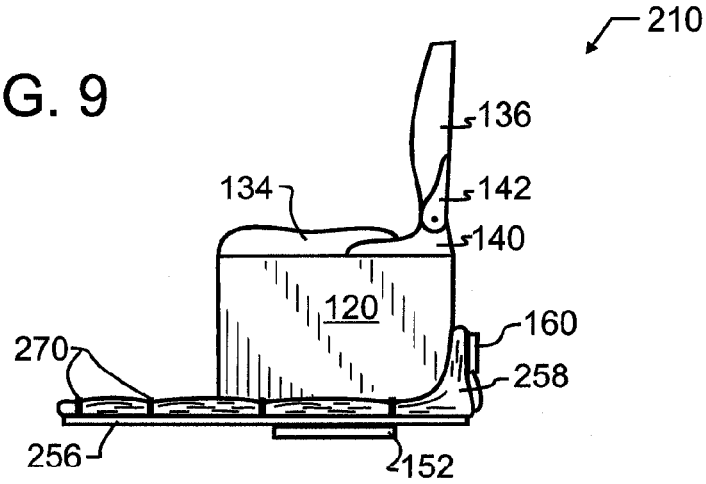
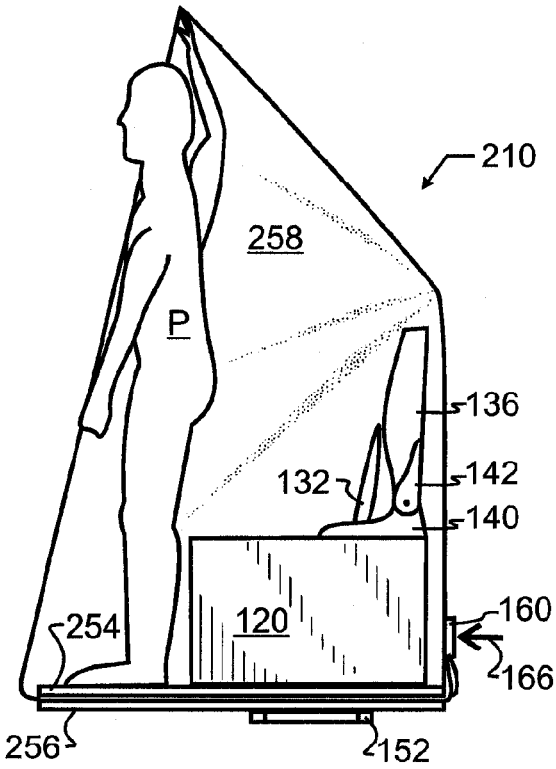
FIG. 10
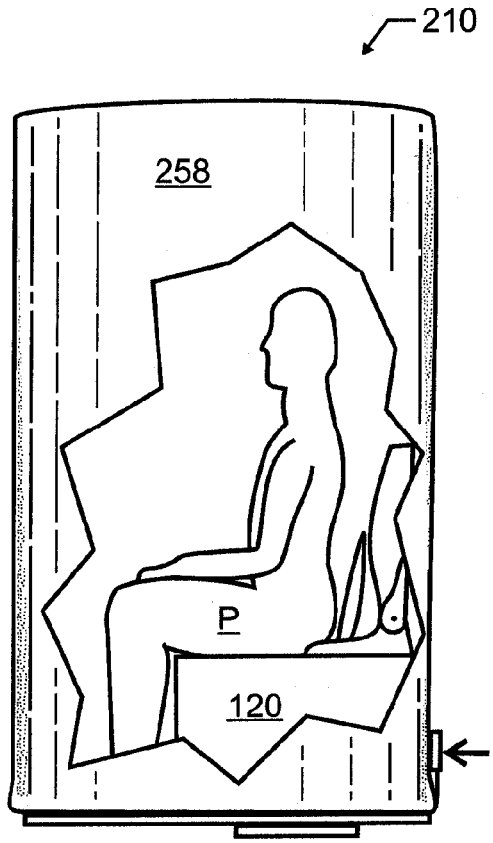
FIG. 11

INFLATABLE TOILET SHELTER

BACKGROUND OF THE INVENTION

1. Field of the Invention

The present invention pertains generally to marine sanitation devices and more specifically to a combined marine boat seat with contained portable toilet and inflatable shelter.

2. Description of the Related Art

Marine activities have been held in great regard throughout the ages. Many bodies of water hold many bounties of fish and other treasures that provide sustenance and many other benefits to mankind. In addition, water neither heats as quickly nor cools as quickly as surrounding air. As a result, the water moderates temperature. When weather patterns induce temperature extremes, an open body of water is very inviting. Such is particularly the case during the heat of summer, when the water cools the adjacent air. In addition, while land may have obstacles such as trees and hills that break the wind, a body of water will also tend to have more breezes due to the flat and unobstructed water surface.

Whether fishing for sustenance or pleasure, or participating in any of the many boating activities on the water, a person can spend many hours or even entire days on the water. In recent years, boating has become an ever more popular form of recreation, providing endless hours of pleasure and leisure to millions of people. Unfortunately, most smaller and medium-sized watercraft have one significant limitation. The vast majority of watercraft, other than large ships and yachts, do not have any sort of toilet. This drawback may be due in part to the fact that the provision of a common marine toilet requires substantial space, eating up valuable deck space. Furthermore, many persons are too embarrassed by both the need to undress and also by the natural sounds and odors associated with using a toilet to be willing to use a toilet in close quarters. Consequently, most smaller watercraft will return to shore or dock each time a person on board needs to use the toilet. Even this can be a problem, since not all landings are provisioned with a toilet. In such instance, the person will be undesirably forced to find a nearby bush or other natural shelter.

Numerous toilet and sanitary devices have been invented for marine craft. Some of the most significant advances in the art have centered around the development of toilets having privacy chambers for changing clothes or for concealing a person using the bathroom. For example, U.S. Pat. No. 3,986,215, issued to Amalfitano and entitled "Detachable toilet seat for small boats", the teachings and contents which are incorporated herein by reference, discloses a toilet sanitary device for use on small toilets, comprising a frame carrying a toilet seat, the frame being extensible over the upper edge or gunwale of the boat over the water. An upright post carries a curtain ring from which is suspended a curtain, which is adjustable to cover the occupant of the toilet when in use. An angle strut is provided to connect from the outer portion of the toilet support frame and fits into a socket secured to a lower portion of the hull, providing extra support for the toilet and its occupant.

While Amalfitano illustrates a toilet seat, there is no receptacle or storage. Consequently, there will be unacceptable contamination of the surrounding waters, and undesirable sounds associated with use of the toilet.

U.S. Pat. No. 4,883,016, issued to Larson and entitled "Collapsible marine privacy chamber", the teachings and contents which are incorporated herein by reference, discusses a collapsible privacy chamber for use aboard a boat or other watercraft. The privacy chamber includes an openable enclosure having an openable top, a sectional support member, a mechanism for anchoring the sectional support member inside of the openable enclosure, an upper support frame, a flexible sheet attachable to the upper support frame such that the flexible sheet can hang from the upper support frame to provide a privacy enclosure, and an upper mechanism for supporting the upper support frame such that the upper support frame can support the flexible sheet. The sectional support member preferably includes a plurality of elongated cooperating segments. The sectional support member cooperates with the anchoring mechanism to anchor the support member in the openable enclosure such that the assembled support member can extend vertically from the enclosure. Preferably, the privacy chamber includes a portable toilet located inside the openable enclosure. The elements of the partial enclosure are preferably collapsible such that they may be disassembled and placed within the enclosure. The enclosure is preferably portable, however, in an alternate embodiment, it is incorporated into the deck of a boat. The Larson structure requires substantial dedicated deck space for the toilet structure, which is otherwise unavailable to the boaters. In addition, the Larson structure is not readily used when the boat is in motion, due to the wind effect on the collapsible framework.

U.S. Pat. No. 5,029,348, issued to Boren and entitled "Head construction for a pontoon boat", the teachings and contents which are incorporated herein by reference, shows the head construction for a pontoon boat comprising a housing having an open top, an open front, and a toilet mounted within the housing. A lid is hinged to the rear edge of the housing and is movable between a horizontal, closed position and an open position where the lid extends vertically. A foldable frame is secured to the housing and can be moved between a folded retracted position, where the frame is located within the housing, to an extended position where the frame extends vertically a substantial distance above the housing. When the lid is moved to the open position, the frame can be pivoted from the retracted to the extended position where the curtain provides an enclosure. The front surface of the curtain is provided with a closable slit to enable a person to enter the enclosure to provide privacy for a person using the head. As with Larson, this Boren structure requires substantial dedicated deck space for the toilet structure, which is otherwise unavailable to the boaters, and the large framework is not conducive to use during boat movement.

A number of artisans in the field of portable toilets illustrate devices such as might be incorporated into the present invention, but which otherwise provide little or no utility in marine applications. Exemplary is U.S. Pat. No. 5,095,556, issued to Franey and entitled "Portable personal commode", the teachings and contents which are incorporated herein by reference. Franey presents a foldable, portable personal commode including a case having an openable top and front. A toilet seat is pivotally mounted to a block secured in the case. A U-shaped support is pivotally mounted to the toilet seat and removably holds the toilet seat in its horizontal position when the free ends of its legs are vertically inserted in sockets secured to the front when it is in the open position. The toilet seat and U-shaped support may be pivoted generally parallel to each other and arranged vertically within the case allowing closing of the front and top of the case. L-shaped arm supports may be removably secured to the vertical sides of the U-shaped support to face either forward or rearward. A removable U-shaped back rest is adjustably inserted in the block of the case. The toilet seat includes affixed hardware which supports a removable collar which slidably receives the opening of a plastic bag retained thereon by a rubber band.

U.S. Pat. No. 5,586,344, issued to Liang and entitled "Portable toilet", the teachings and contents which are incorporated herein by reference, discusses a portable toilet which can be readily assembled and disassembled, including a base, a bowl detachably connected to the base, and an upper frame detachably connected to the base by two suspension tubes. The portable toilet can also be used in a car.

European patent 389,204 by Bly, entitled "Portable commode", the teachings and contents which are incorporated herein by reference, discloses a portable commode comprising legs which support a tubular frame, the frame defining a chair-like configuration that includes arm rests and front and rear parallel horizontal cross-bar members. European patent EP 689,790 by Liao, entitled "Portable toilet", the teachings and contents which are incorporated herein by reference, discloses a portable toilet including a bowl-like base defining an open chamber. A marine portable toilet is illustrated in U.S. Pat. No. 3,094,707 by Fleming, entitled "Combination toilet and chemical treating facility", the teachings and contents which are incorporated herein by reference.

A number of toilet and shelter combinations for non-marine applications are also illustrated in the prior art. Exemplary is U.S. Pat. No. 5,379,466, issued to Davies, entitled "Portable privacy closet", the teachings and contents which are incorporated herein by reference, which discloses a portable privacy closet which may be selectively moved from a raised to a lowered position. When the closet is in the raised position it provides a private area for use as a changing room or for housing a toilet facility, and when in the lowered position, the closet provides a weathertight storage area.

U.S. Pat. No. 5,937,452, issued to Brewer, entitled "Portable bathroom assembly", the teachings and contents which are incorporated herein by reference, illustrates a portable toilet assembly including a rigid frame assembly. A flexible tent assembly removably coupled about the rigid frame and a toilet seat is removably situated within the rigid frame.

A number of U.S. patents also illustrate various toilet shelter constructions, the teachings and contents which are incorporated herein by reference, including: U.S. Pat. No. 268,240 by Jones, entitled "Folding bathing cabinet"; U.S. Pat. No. 1,538,311 by Anticknap, entitled "Collapsible bathhouse"; U.S. Pat. No. 1,652,581 by Roberts, entitled "Portable toilet or convenience"; U.S. Pat. No. 1,990,804 by Watson, entitled "Portable dressing booth"; U.S. Pat. No. 4,909,268 by Maggio, entitled "Collapsible room structure"; U.S. Pat. No. 4,974,265 by Maggio, entitled "Collapsible privacy shelter"; U.S. Pat. No. 4,979,242 by Maggio, entitled "Collapsible room shelter"; and U.S. Pat. No. 6,378,142 by Gray, entitled "Foldable privacy screen and portable toilet combination".

Two U.S. patent documents illustrate inflatable and portable toilet shelters, including U.S. Pat. No. 3,629,875 by Dow et al, entitled "Portable inflatable enclosure for personal use"; and 20090025302 A1 by Wang, entitled "Inflatable tent", the teachings and contents which are incorporated herein by reference.

Two U.S. patents, the teachings and contents which are incorporated herein by reference, illustrate the combination of an automobile seat together with a toilet structure: U.S. Pat. No. 1,508,888 by Klatt, entitled "Auxiliary seat for automobiles"; and U.S. Pat. No. 4,785,483 by Wise, entitled "Integrated passenger seat and toilet apparatus and method".

U.S. Design Pat. No. 378,540, by the present inventor and entitled "Portable shelter", the teachings and contents which are incorporated herein by reference, illustrates a portable shelter comprising a plurality of U-shaped bails connected to a central axis rod.

U.S. published patent application 2001/0044952 by the present inventor, entitled "Portable marine privacy toilet", the teachings and contents which are incorporated herein by reference, illustrates a combination boat seat and portable toilet, with a framework shelter. Undesirably, this structure is not readily used when the boat is in motion, due to the wind effect on the collapsible framework, and the framework requires space even when collapsed. Further, this structure does little to mask toilet sounds and odors, and when in use, the structure can get uncomfortably hot.

As may be recognized, many previous attempts to provide a solution to the need for a practical and effective portable marine toilet are unsatisfactory, because they require individuals to sit in uncomfortable positions, such as over the edge of a boat, or use ineffective privacy coverings such as sail-like curtains, which may be unwieldy under windy conditions. Additionally, ineffective sanitary means, such as those involving the direct discharge of sewage into the surrounding water or which do not effectively sterilize contaminated matter, present serious questions of cleanliness and reduce product appeal, and can even result in violations of state or federal law.

Marine sanitation devices are specially designed for use on pleasure craft, and are made to conform to Coast Guard standards regarding discharge of sewage into restricted waters. other benefits of portable marine toilets include the neutralization of odor causing molecules, and the disinfection of potentially hazardous matter. Space is limited on boats, and the space which is available is usually devoted to boat seats, navigational equipment, and storage areas or housing for fishing and boating accessories.

Another drawback of water craft and portable toilets is the fact that rough waves or rocking of the boat can make portable toilets potentially dangerous if they are unsecured, possibly resulting in their sliding across the deck and causing damage. Thus, if a device could be built which would maximize the efficient use of space on board, while providing an aesthetically pleasing and secure housing, an important contribution to the art would be made. The present invention provides an effective means by which a conventional portable toilet can be used on a boat by incorporating a boat seat into the protective housing of a portable toilet, providing a practical solution to this longfelt need.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is an inflatable toilet shelter. A boat seat housing encompasses a portable toilet. A seat cushion removably covers the boat seat housing. An inflatable cover is coupled to the boat seat housing and defines a pressurizable interior operative to contain a human therein. A fan forcing air from an exterior of the inflatable toilet shelter to the pressurizable interior operatively inflates the inflatable cover.

OBJECTS OF THE INVENTION

Exemplary embodiments of the present invention solve inadequacies of the prior art by providing an effective solution to the long-felt need for a portable toilet which can be securely located on the deck of a conventional boat, while also providing privacy, sound and odor masking, a stable and comfortable structure that can withstand high wind speeds, and which maximizes the efficient use of space on deck by incorporating the portable toilet into the exterior housing of a boat seat. The inflatable toilet shelter comprises a substantially box-shaped housing, adapted for closely receiving a portable toilet therein, and a boat seat assembly, which includes a brace for connecting the boat seat assembly to the housing. The housing preferably includes four walls and a bottom, the walls each having top and lateral side edges and extending upwardly from the bottom. An opening may be provided on the housing for allowing the flush pedal of a so-equipped portable toilet to extend there through. Fastened to the base of the boat seat is the bottom of a lightweight tent, and preferably a swivel upon the bottom allowing the toilet to be vertically pivotal.

The boat seat assembly preferably includes a boat seat, a boat seat back, and a support brace comprising first and second support members hingedly connected together. The first member connects the boat seat back to the second member. The inner surface of the generally L-shaped second member, which is fixedly attached to the top of the walls, defines a seat receiving portion for supportably receiving the boat seat, which is removably attached to the housing by fastening means.

An inflatable cover is coupled to the boat seat housing and defines a pressurizable interior. A fan forcing air from an exterior of the inflatable toilet shelter to the pressurizable interior operatively inflates the inflatable cover.

A first object of the invention is to provide a portable toilet for marine craft which is sanitary, secure, and space saving, the toilet being designed to also be used as a swivel boat seat. A second object of the invention is to provide with the portable toilet a privacy cover to conceal a user. Another object of the present invention is to enable ready removal of the boat seat bottom cushion to allow easy access to the toilet. A further object of the invention is to provide a readily set-up shelter which can withstand relatively high windspeeds, which will remain comfortable even on hot days, and which will mask toilet sounds and diffuse toilet odors. Yet another object of the present invention is to substantially maintain the footprint of the swivel boat seat regardless of whether the toilet is in use, and the appearance of a swivel boat seat when the toilet is not in use.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIG. 5 illustrates a side elevational view of the preferred embodiment inflatable toilet shelter of FIG. 4, when the portable toilet is not in use and the shelter is stowed.

FIG. 6 illustrates a side elevational and partial cut-away view of the inflatable toilet shelter of FIG. 4, when the inflatable toilet shelter is being raised for use prior to use of the portable toilet.

FIG. 7 illustrates a side elevational and partial cut-away view of the inflatable toilet shelter of FIG. 4, with the inflatable toilet shelter raised and with the portable toilet in use.

FIG. 9 illustrates a side elevational view of a first alternative embodiment inflatable toilet shelter similar to that of FIG. 4, when the portable toilet is not in use and the shelter is stowed.

FIG. 10 illustrates a side elevational and partial cut-away view of the first alternative embodiment inflatable toilet shelter of FIG. 9, when the inflatable toilet shelter is being raised for use prior to use of the portable toilet.

FIG. 11 illustrates a side elevational and partial cut-away view of the first alternative embodiment inflatable toilet shelter of FIG. 9, with the inflatable toilet shelter raised and with the portable toilet in use.

DESCRIPTION OF THE PREFERRED EMBODIMENT

Figure 1:
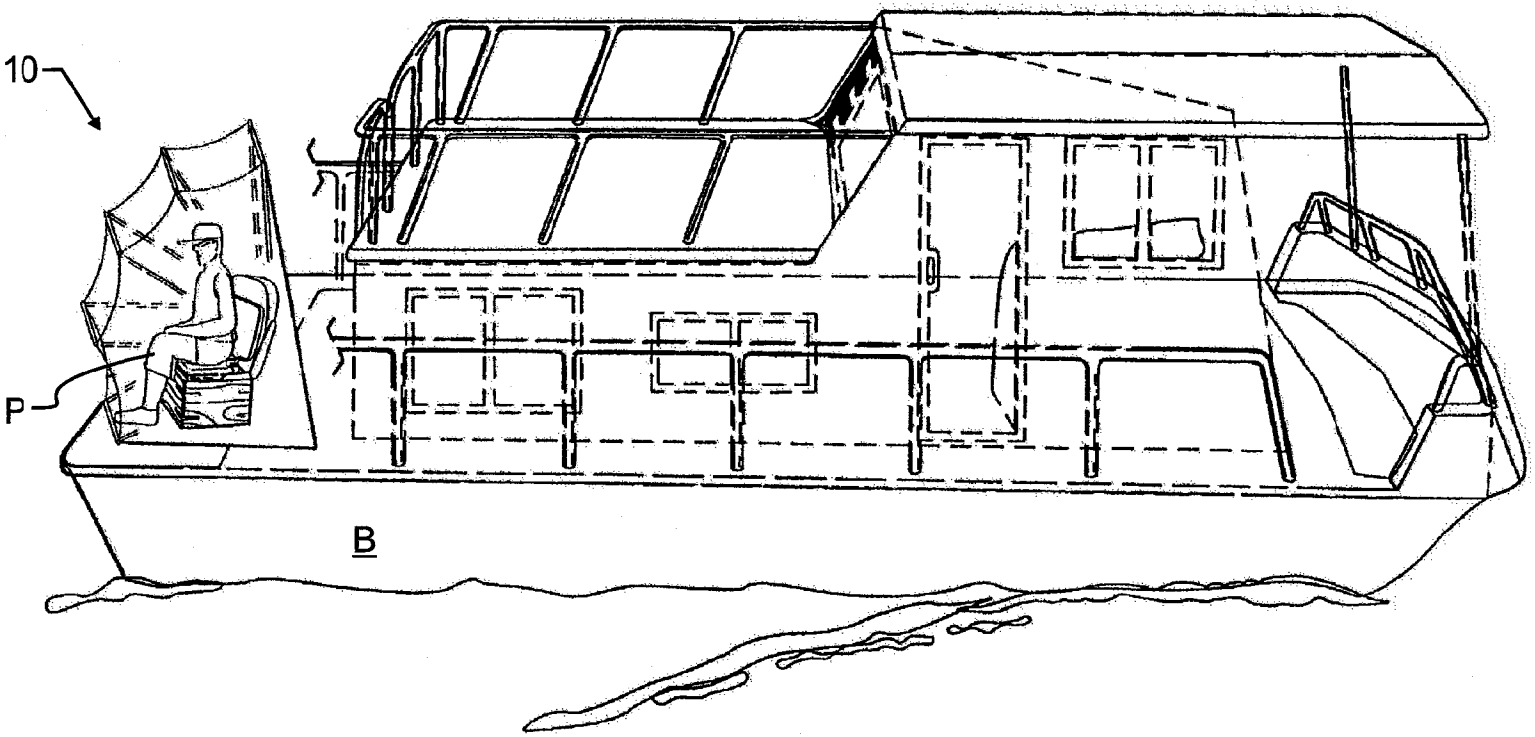
FIG. 1 (PRIOR ART)
FIG. 1 illustrates an environmental, perspective view of a prior art portable marine privacy toilet being used on the deck of a water craft.
Figure 2:
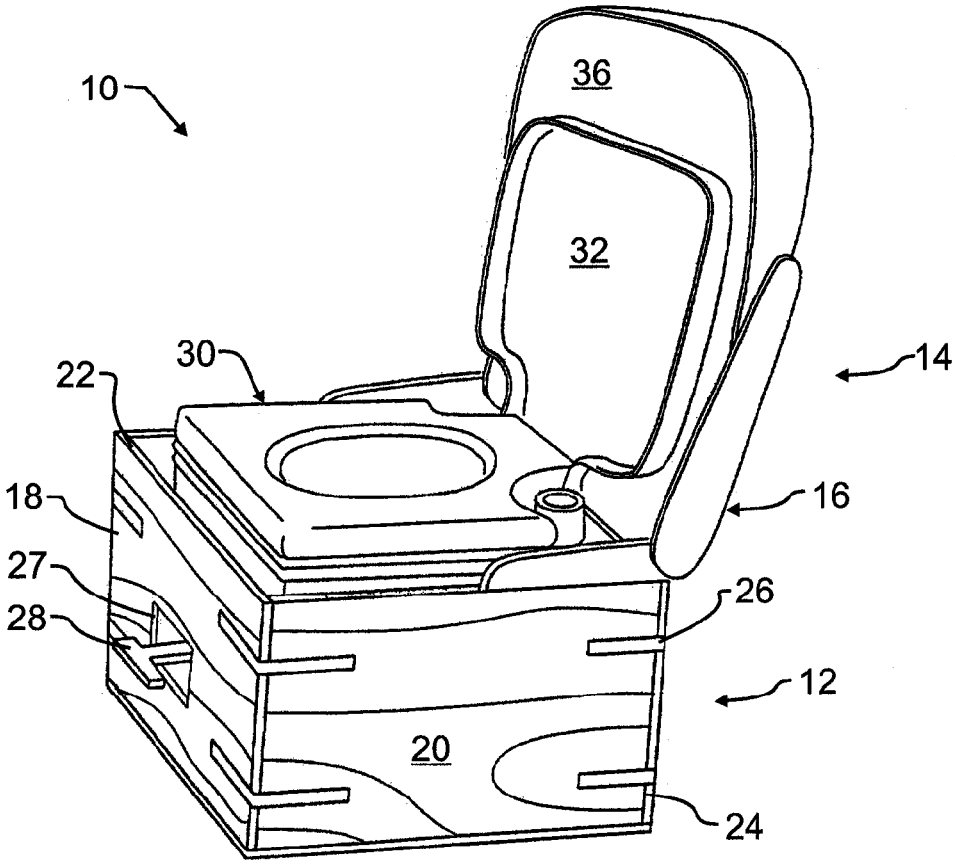
FIG. 2 (PRIOR ART)
FIG. 2 illustrates a projected view of the prior art portable marine toilet of FIG. 1, showing the portable toilet inside the housing.

Manifested in the preferred embodiment, the present invention provides a portable toilet for marine craft. As diagrammatically illustrated in prior art FIG. 1, a view of a portable toilet for marine craft is depicted in which a person P is shown using portable toilet for marine craft 10, the portable toilet 10 being located on the deck of a conventional boat B. In prior art FIG. 2, it can be seen that the portable marine privacy toilet 10 comprises a substantially box-shaped housing 12 adapted for closely receiving a portable toilet therein so as to allow a user's legs to always be on the outside of the housing 12 to insure comfort. The toilet 10 also comprises a boat seat assembly 14, which includes a hinged support structure or brace 16 for connecting the boat seat assembly 14 to the housing 12. The housing 12 preferably includes front 18, back, lateral side walls 20 and a bottom, the walls each having a top portion 22 and lateral side edges, generally 24, and extending upwardly from the bottom. Each wall is joined to an adjacent wall at a lateral side edge 24 thereof by at least one fastener, each generally 26. Alternatively, the walls can be integrally formed together, the housing 12 comprising injection-molded plastic to form a one-piece structure.

The front wall 18 of the housing 12 preferably has a generally rectangular-shaped opening 27 disposed thereon for receiving the flush pedal or lever 28 therethrough of a portable toilet seat 30 and cover 32, although the opening 27 and flush pedal 28 can be absent in alternative embodiments. Housing 12 may be covered with a vinyl sleeve or liner (not shown) to match boat seat 34 in an alternative embodiment of the invention.

Figure 3:
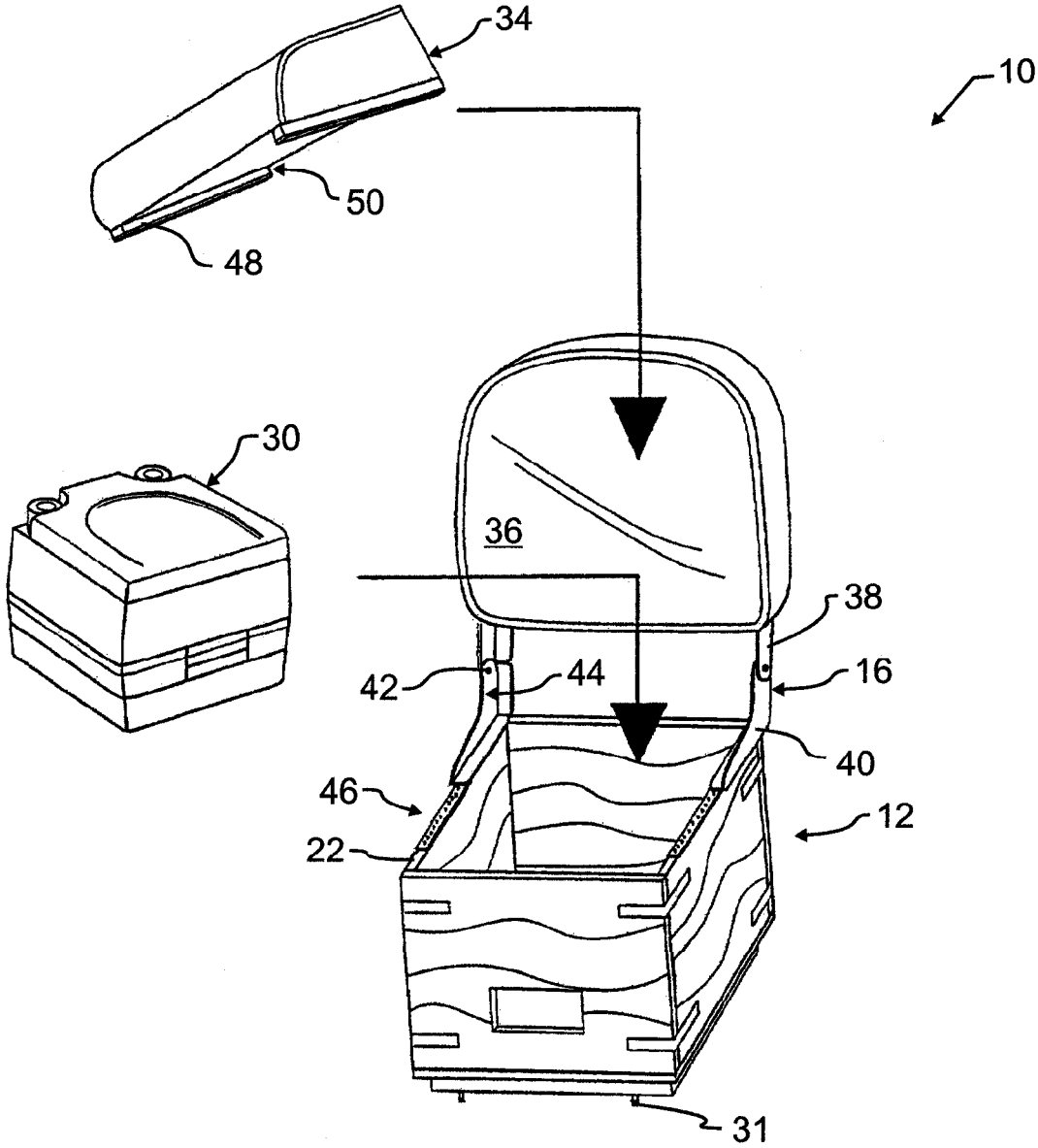
FIG. 3 (PRIOR ART)
FIG. 3 illustrates an exploded view of the prior art portable marine privacy toilet of FIG. 2.

Turning now to the prior art exploded view of FIG. 3, boat seat assembly 14 preferably includes a boat seat 34, a boat seat back 36, and a support brace 16 comprising first and second support members 38 and 40, respectively, hingedly connected together. The first support member 38 connects the boat seat back 36 to the second support member 40 with the hinge 42 allowing the seat back 36 to fold forwardly over, as known in the art of boat seats. The inner surface 44 of the generally L-shaped second support member 40, which is fixedly attached to the top 22 of the walls, defines a seat receiving portion for supportably and removably receiving boat seat 34. The second support member 40 can also comprise a spacer element to allow the top of the portable toilet to protrude above the top edge 22 of the housing 12.

Boat seat back 36 and boat seat 34 may be padded, comprising an inner support, and an exterior liner preferably made of waterproof polymeric material, such as polypropylene, polyvinyl chloride, or similar material. Housing 12 further comprises a fastener 46 for removably connecting the boat seat 34 to the housing 12 and a mating fastener 48 located on an underlying seat support rod 50. In the illustrated prior art embodiment, fastener 48 is a hook and loop fastener, and is brought into abutting and reversibly connectible relationship with its mating fastener 46 by proper placement of seat 34 on housing 12.

Various embodiments of apparatus designed in accord with the present invention have been illustrated in the various figures. The embodiments are distinguished by the hundreds digit, and various components within each embodiment designated by the ones and tens digits. However, many of the components are alike or similar between embodiments, including those of prior art FIGS. 1-3, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description.

Figure 4:
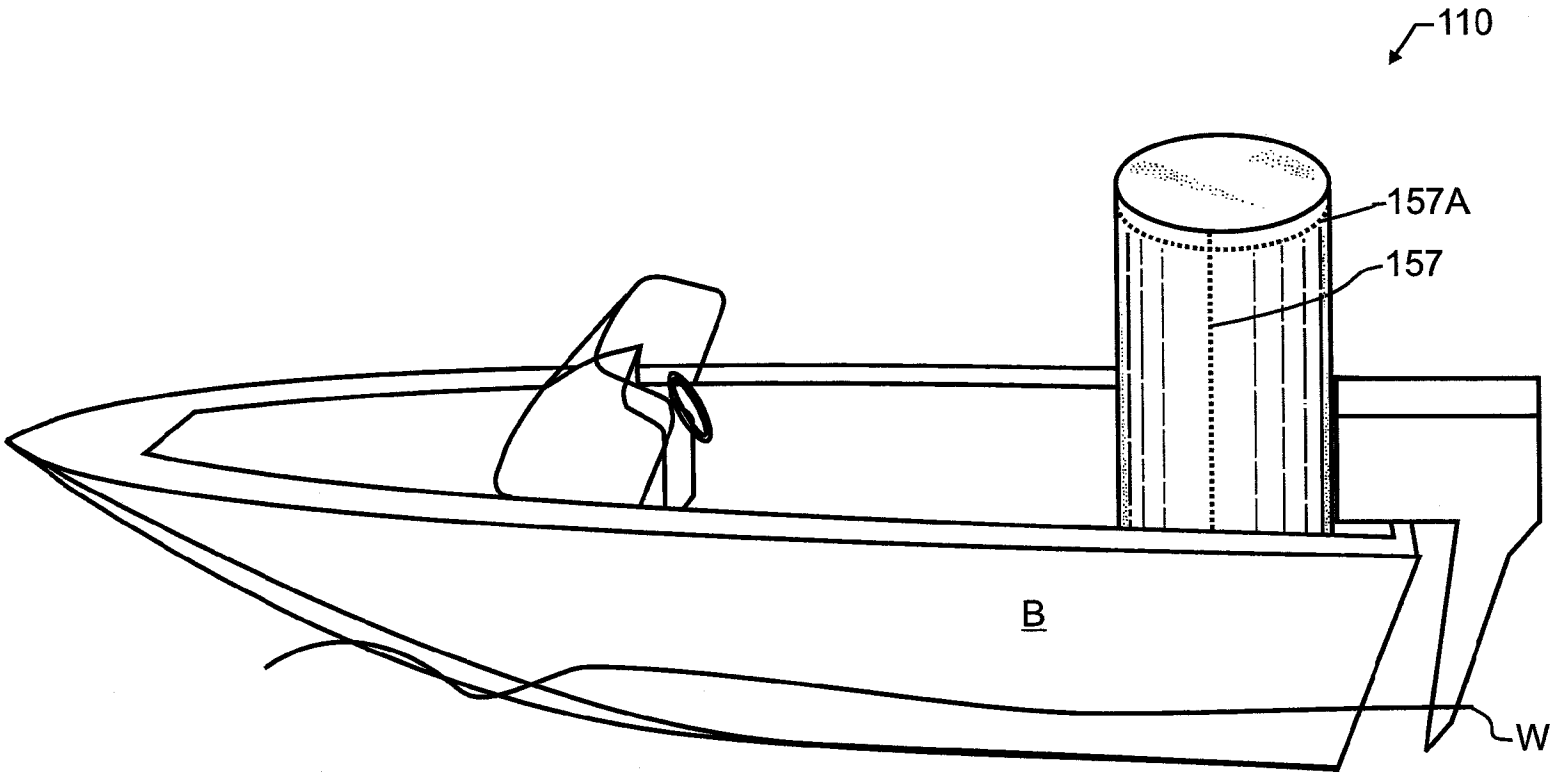
FIG. 4 illustrates an environmental, perspective view of a preferred embodiment inflatable toilet shelter designed in accord with the teachings of the present invention and being used on the deck of a water craft.
Figure 8:
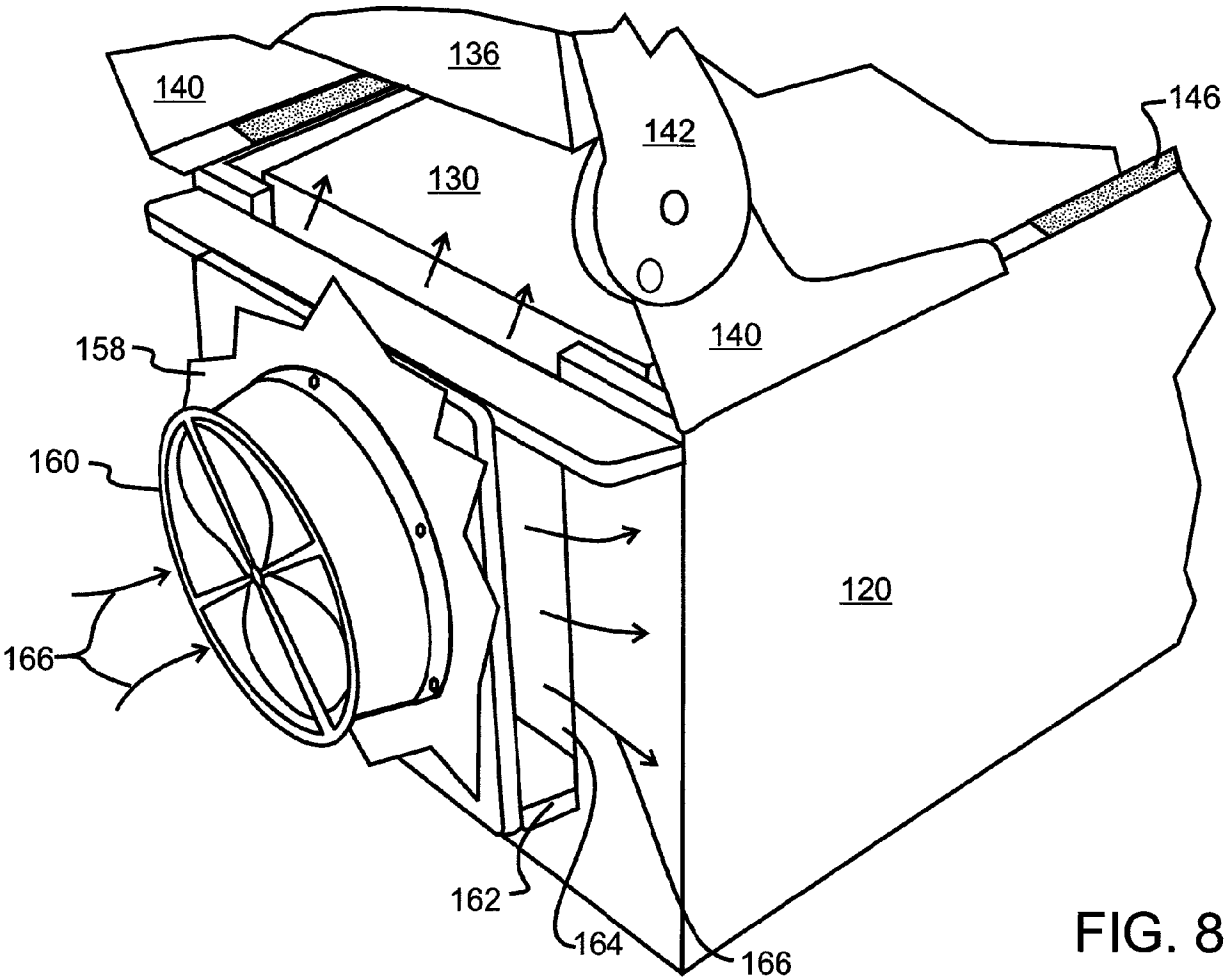
FIG. 8 illustrates an enlarged, projected, and partial cut-away view of the preferred embodiment inflatable toilet shelter of FIG. 4, emphasizing the air flow from the fan into the shelter.

As diagrammatically illustrated in FIG. 4, a view of a preferred embodiment inflatable toilet shelter 110 is depicted in an operative and inflated state, while located on the deck of a conventional boat B traveling within a water body having a surface denoted by line W. It should be understood that the present invention embraces configurations and designs for all conventional boat designs such as commonly known in the art, provided there is at least one seat available which may be constructed or adapted as taught herein.

FIGS. 5-8 illustrate a preferred embodiment inflatable toilet shelter designed in accord with the teachings of the present invention. Inflatable toilet shelter 110 comprises a substantially box-shaped housing 120 adapted for closely receiving a portable toilet 130 therein so as to allow a user's legs to always be on the outside of the housing 120 to insure comfort. Housing 120 can be comprised of any substance, including polymeric material, metal, and wood, and can be designed according to any shape, size, appearance, and dimensions, according to the needs of the user and the specifications of the manufacturer.

Inflatable toilet shelter 110 also comprises a boat seat 134, a boat seat back 136, and a hinge 142 coupling boat seat back 136 to support member 140. Hinge 142 allows seat back 136 to fold forwardly over onto boat seat 134, as known in the art of boat seats. The inner surface of the generally L-shaped second support member 140, as with support member 40, defines a seat receiving portion for supportably and removably receiving boat seat 134. Support member 140 can also comprise a spacer element to allow the top of portable toilet 130 to protrude above the top edge of housing 120.

Boat seat back 136 and boat seat 134 may be padded, comprising an inner support, and an exterior liner preferably made of waterproof polymeric material, such as polypropylene, polyvinyl chloride, or similar material. It should be understood that the specification embraces configurations and designs for all boat seats 134, as well as conventional boat seat designs such as commonly known in the art.

Housing 120 may preferably further comprise a fastener such as fastener 46 for removably connecting boat seat 134 to housing 120. A mating fastener such as mating fastener 48 may further be located on an underlying seat support rod similar to rod 50. In the preferred embodiment, fastener 48 may for exemplary purposes be a hook and loop fastener that is brought into abutting and reversibly connectible relationship with its mating fastener 46 by proper placement of seat 134 on housing 120. Any conventional fastener other than the hook and loop type can be used for attaching boat seat 134 to the top portions of housing 120, including adhesive materials, clips, snaps, and interlocking attachment devices. Housing 120 may further be covered with a vinyl sleeve or liner (not shown) to match boat seat 134 in one embodiment of the invention.

Inflatable toilet shelter 110 may also preferably have a swivel assembly 152 attached to the bottom for allowing the inflatable toilet shelter 110 to be pivotal about a vertical axis. The swivel assembly can comprise any means for allowing inflatable toilet shelter 110 to be pivotal, including a rotatable bearing unit. In the preferred embodiment of the invention, this rotatable bearing unit includes upper and lower bearing plates, each comprising a ring-shaped depression which, when matched together, define a raceway for bearing balls. Although inflatable toilet shelter 110 is portable, housing 120 or swivel assembly 152 may preferably include at least one fastener for fastening inflatable toilet shelter 110 to an underlying or upstanding support surface, such as a conventional boat seat mounting plate or boat floor or deck.

A pair of base plates 154, 156 preferably sandwich and thereby capture the bottom edge of a privacy cover 158 therebetween. Cover 158 shelters and conceals a person when using toilet 130. Cover 158 can comprise any suitable material, but is preferably non-transparent, lightweight, and water resistant. For exemplary purposes, this might be rip-stop nylon such as commonly used in tents and the like, though any other suitable material may be used. Any kind of connector between housing 120 and cover 158 can be used, base plates 154, 156 being a preferred embodiment of the connector. While cover 158 may take any suitable geometry, the preferred embodiment of cover 158 herein described is cylindrical when inflated, which provides for decreased wind resistance from all directions, and increased stability.

A fan 160 is provided on the back of housing 120, and is separated from the interior of housing 120 by spacers 162 that define an open space 164. Air flows from the exterior of cover 158 through fan 160, where it is accelerated and thereby slightly pressurized. The general air flow direction is illustrated by air flow arrows 166. As the air exits fan 160, some air will pass between housing 120 and toilet 130, in turn creating a gentle air flow past a person P, cooling the person and thereby improving comfort in warm weather. The amount of air flow will be controlled at least to some degree by the spacing between toilet 130 and hosing 120, and also at least in part by the porosity of cove 158. Additional air will pass through open space 164 between housing 120 and cover 158.

Fan 160 is preferably a fan which is capable of producing and maintaining a significant static pressure differential, to better inflate cover 158. Fan 160 is also preferably electrically coupled directly into the boat wiring to a battery carried on board. Many smaller boats operate 12 Volt DC systems, so a 12 Volt DC fan 160 is generally preferable. However, some boats operate at higher voltages, including 120 VAC, and other boats may have or be provided with voltage inverters and converters, so any suitable voltage will be used, together with appropriate known electrical connectors for coupling fan 160 into the electrical system.

While for many applications, fan-generated noise is undesirable, in the preferred embodiment this noise is very synergistic, since the noise masks ordinary toilet sounds. Consequently, even if another person is very close to inflatable toilet shelter 110, person P will be assured that fan 160 will adequately mask sound. Likewise, the porosity of cover 158 will not only control the amount of air flow, the porosity will also provide a diffusing and dispersing of toilet odors. Once again, another person can remain close to inflatable toilet shelter 110 without concern for odor.

FIG. 5 illustrates when inflatable toilet shelter 110 is not in use and cover 158 is stowed, while FIG. 6 illustrates inflatable toilet shelter 110 being raised for use prior to use of portable toilet 130, with toilet lid 132 raised. Since cover 158 is larger in interior diameter than the largest dimension of housing 120, a zipper 157 or 157A or other suitable fastener visible in FIG. 4 is provided which allows cover 158 to be draped around housing 120 prior to inflation. As person P holds cover 158 up, person P will also raise and close zipper 157 or 157A or equivalent fastener. FIG. 7 illustrates inflatable toilet shelter 110 raised by air pressure generated by fan 160, with portable toilet 130 in use.

One limitation of inflatable toilet shelter 110 is where person P stands. In the preferred embodiment illustrated in FIGS. 5-8, person P stands directly onto cover 158. With relatively light weight fabric, cover 158 may quickly become damaged or destroyed. Consequently, a special coating or additional layers of durable material may be adhered to cover 158 in the foot region of person P.

As an alternative to reinforcing cover 158 in the area where a person would stand, FIGS. 9-11 illustrate an alternative embodiment. In alternative embodiment inflatable toilet shelter 210, base plates 154, 156 may be extended forward sufficiently for a person to step and stand directly thereon.

When inflatable toilet shelter 110 is being used as a boat seat, cover 158 will preferably be snugly secured to housing 120. This may for exemplary purposes be accomplished using a cargo net 170 or similar netting, preferably with an elastic band or elastic shock cord or the like around the top. Alternatively, a set of tie-down fasteners such as 270 may be used. In addition thereto, or instead, a decorative cover or band may be provided that wraps circumferentially about box 120 and over cover 158.

While the foregoing details what is felt to be the preferred embodiment of the invention, no material limitations to the scope of the claimed invention are intended. Further, features and design alternatives that would be obvious to one of ordinary skill in the art are considered to be incorporated herein. For exemplary purposes only, and not limiting the present invention solely thereto, it should be apparent that the present invention embraces any and all models of portable toilets 130 such as in conventional usage or commonly known, housing 120 being suitably dimensioned or adaptable to receive them. Therefore, any boat seat incorporating or housing a toilet, especially a portable marine toilet, is fully encompassed. The scope of the invention is set forth and particularly described in the claims hereinbelow.

I claim:

1. An inflatable toilet shelter, comprising:

a boat seat housing;

a seat cushion removably covering said boat seat housing;

a portable toilet within said boat seat housing;

an inflatable cover coupled to said boat seat housing and defining a pressurizable interior operative to contain a human therein; and a fan forcing air from an exterior of said inflatable toilet shelter to said pressurizable interior to thereby inflate said inflatable cover.

2. The inflatable toilet shelter of claim 1, further comprising:

a boat seat back, a brace for connecting said boat seat back to said housing; and at least one connector for removably connecting said boat seat to said housing.

3. The inflatable toilet shelter of claim 1, wherein said inflatable cover further comprises a woven fabric.

4. The inflatable toilet shelter of claim 3, wherein said woven fabric further comprises rip-stop nylon.

5. The inflatable toilet shelter of claim 1, further comprising an air flow gap between an interior of said boat seat housing and said portable toilet.

6. The inflatable toilet shelter of claim 1, further comprising a spacer offsetting said fan from said boat seat housing and defining an air flow gap therebetween.

7. The inflatable toilet shelter of claim 6, wherein said air flow gap couples air from said fan to an exterior of said boat seat hosing and an interior of said inflatable cover.

8. The inflatable toilet shelter of claim 1, further comprising a base plate below and adjacent to said boat seat housing, wherein said inflatable cover is sandwiched between said base plate and said boat seat housing.

9. The inflatable toilet shelter of claim 1, wherein said boat seat housing has a bottom with a swivel attached thereon for allowing said inflatable toilet shelter to be pivotal about a vertical axis.

* * * * *